US008328284B2

(12) United States Patent
Loomis

(10) Patent No.: US 8,328,284 B2
(45) Date of Patent: Dec. 11, 2012

(54) LOCK RELEASE ASSEMBLY FOR A COLLAPSIBLE CHAIR HAVING A FOLD-DOWN BACK

(76) Inventor: Mark Loomis, La Habra, CA (US)

( * ) Notice: Subject to any disclaimer, the term of this patent is extended or adjusted under 35 U.S.C. 154(b) by 65 days.

(21) Appl. No.: 12/800,782

(22) Filed: May 24, 2010

(65) Prior Publication Data

US 2011/0285193 A1 Nov. 24, 2011

(51) Int. Cl.
*A47C 4/04* (2006.01)

(52) U.S. Cl. ..... 297/378.12

(58) Field of Classification Search ..... 297/378.12, 297/378.1, 378.14
See application file for complete search history.

(56) References Cited

U.S. PATENT DOCUMENTS

| | | | | |
|---|---|---|---|---|
| 3,001,821 | A * | 9/1961 | Marechal | 297/366 |
| 3,037,812 | A * | 6/1962 | Monroe | 297/362.13 |
| 3,517,965 | A * | 6/1970 | Cowles et al. | 297/374 |
| 5,855,414 | A * | 1/1999 | Daniel et al. | 297/378.13 |
| 6,422,654 | B1 * | 7/2002 | Grove | 297/440.16 |
| 6,685,266 | B2 * | 2/2004 | James et al. | 297/250.1 |
| 6,786,553 | B1 | 9/2004 | Grove | |
| 7,510,243 | B1 * | 3/2009 | Hung | 297/378.12 |
| 7,857,385 | B2 * | 12/2010 | Zink et al. | 297/256 |
| 2007/0236061 | A1 * | 10/2007 | Meeker et al. | 297/250.1 |

* cited by examiner

*Primary Examiner* — Milton Nelson, Jr.
(74) *Attorney, Agent, or Firm* — Morland C. Fischer

(57) ABSTRACT

Lock release assemblies which are accessible at the rear of a rotatable fold-down back of a collapsible home or office chair. The lock release assemblies are adapted to be manually manipulated by the user to control the rotation of the fold-down back from a locked upright position standing vertically above the seat of the chair to an unlocked folded position lying horizontally over the seat in face-to-face alignment therewith. With the back rotated to its folded position, the chair will have a compact, space-efficient configuration which is suitable for storage and/or transport.

12 Claims, 18 Drawing Sheets

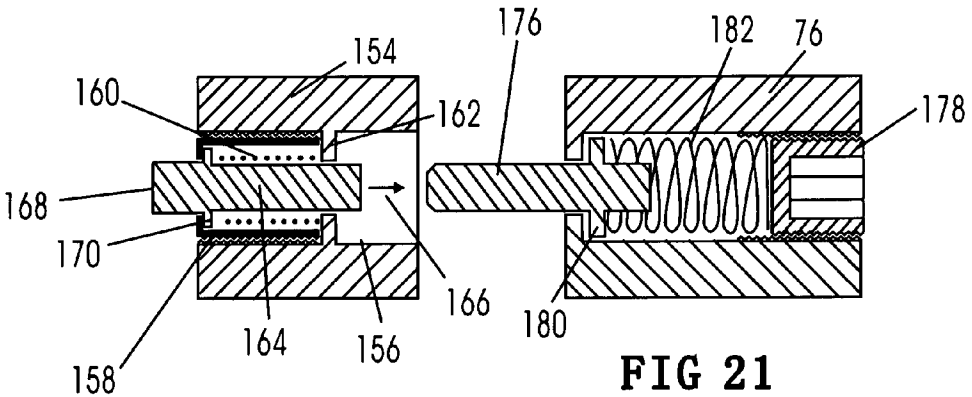
FIG 21
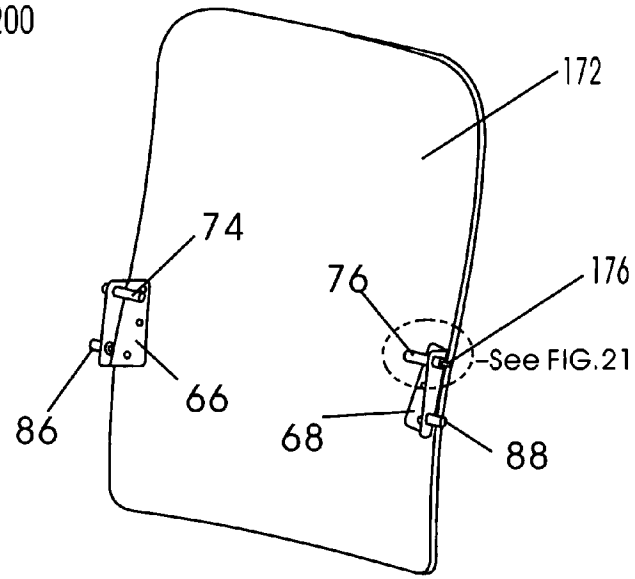
FIG 20
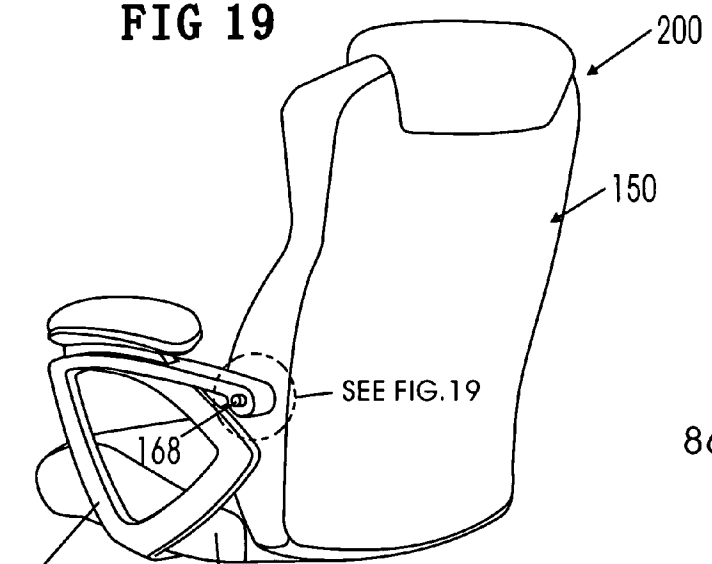
FIG 19
FIG 18

LOCK RELEASE ASSEMBLY FOR A COLLAPSIBLE CHAIR HAVING A FOLD-DOWN BACK

BACKGROUND OF THE INVENTION

1. Field of the Invention

This invention relates to lock release assemblies that are accessible at the rear of a fold-down back of a collapsible home or office chair. Manually manipulating the lock release assemblies allows the fold-down back of the chair to be rotated from a locked upright position standing vertically above the seat of the chair during use to an unlocked folded position lying horizontally over the seat to facilitate a compact, space-efficient configuration suitable for storage or transport.

2. Background Art

Occasionally, it is necessary to transport or store one or more chairs of the kind having a seat, a back standing vertically above the seat to support the user's back thereagainst, and a pair of arms located adjacent opposite sides of the seat. In those cases where a large number of chairs are to be shipped or stored, a correspondingly large amount of space will typically be required which increases both the shipping/storage costs and inefficiency. For example, where the chairs are to be shipped by boat and/or by truck, the cargo space available may be quickly consumed by a relatively few chairs. To overcome this problem, it is known to disassemble the chairs prior to shipment. However, such disassembly also mandates an additional assembly once the chairs reach their final destination. Consequently, time is wasted during both assembly and disassembly which contributes to the overall shipping costs that are ultimately passed through to the purchaser. Moreover, parts of the chair can become lost following disassembly which may prevent reassembly and, therefore, result in the chair being ultimately scrapped. In certain situations, assembly of the chair is left to the purchaser. In this case, some special skill and/or tools are often required before the chair is ready to use. If the purchaser is unable to easily complete the assembly in a reasonable time, frustration may occur which can result in the chair going unused or returned to the vendor.

Accordingly, it would be advantageous to have a collapsible chair having a rotatable fold-down back where the chair is capable of being quickly and easily disposed in a compact, space-efficient configuration suitable for storage and/or transport without having to first disassemble the chair and then reassemble the chair prior to use. In this regard, one example of a collapsible chair having a rotatable fold-down back is available by referring to U.S. Pat. No. 6,786,553 which issued to James E. Grove on Sep. 7, 2004.

SUMMARY OF THE INVENTION

Briefly, and in general terms, lock release assemblies are disclosed which are accessible at the rear of a rotatable fold-down back of a collapsible home or office chair. The lock release assemblies are adapted to be manually manipulated by the user to control the rotation of the fold-down back from a locked upright position standing vertically above the seat of the chair to an unlocked folded position lying horizontally over the seat in face-to-face alignment therewith. With the back rotated to its folded position, the chair will have a compact, space-efficient configuration which is suitable for storage and/or transport.

In a first preferred embodiment for a lock release assembly, a rotatable latch is coupled to a pair of retractable locking pins by way of a cable that runs through a hollow back bar that is affixed at one end thereof to the fold-down back of the collapsible chair. The opposite end of the back bar is slidably received by and removable from a seat back coupling channel located below the seat of the chair. The locking pins project outwardly from the back bar for removable receipt by respective pin holes formed in the coupling channel whereby to hold the fold-down back in the upright position relative to the seat. The latch is accessible at the rear of the chair back. A rotational force applied by the user to the latch causes the cable to undergo tension so as to cause a corresponding pulling force to be applied to each of the locking pins. Accordingly, the locking pins are retracted from their pin holes in the seat back coupling channel to permit the fold-down back to be rotated to its folded position relative to the seat and the back bar to slide outwardly from the coupling channel.

In a second preferred embodiment for a lock release assembly, a pair of pull tabs project through a pull tab cavity at the rear of the fold-down back of the collapsible chair. Each pull tab is coupled to a retractable locking pin by way of a locking cable. The locking pins are slidably received by respective locking collars of a pair of side brackets that are affixed to opposite sides of the chair back. The locking pins extend outwardly from the locking collars and into removable locking engagement with pin holes formed in the chair arms so as to hold the fold-down back in its locked upright position relative to the seat. A squeezing force applied by the user pulls the pull tabs through the pull tab cavity and towards one another. Accordingly, the locking cables undergo tension so as to cause a corresponding pulling force to be applied to each of the locking pins, whereby the locking pins are retracted from the pin holes in the chair arms and pulled inwardly through their locking collars to permit the fold-down back to be rotated to its unlocked folded position relative to the seat.

In a third preferred embodiment for a lock release assembly, a pair of finger levers project through finger lever slots at the rear of the fold-down back of the collapsible chair. The finger levers are attached to retractable locking pins that are slidably received by respective locking collars of a pair of side brackets that are affixed to opposite sides of the chair back. The locking pins are urged by compression springs to project outwardly from the locking collars and into removable locking engagement with locking holes formed in the chair arms so as to hold the fold-down back in its locked upright position relative to the seat. A pushing force applied by the user to the finger levers causes the finger levers to move through the finger lever slots and towards one another. Accordingly, the locking pins are correspondingly retracted from the locking holes in the chair arms and pulled inwardly through their locking collars against the normal bias of the compression springs to permit the fold-down back to be rotated to its unlocked folded position relative to the seat.

In a fourth preferred embodiment for a lock release assembly, a pair of push button housings are mounted inside holes formed in the arms of the collapsible chair. Push button plungers are located in and slidable through respective ones of the push button housings. The push button plungers are axially aligned with respective locking pins that are slidably received by locking collars of side brackets that are affixed to opposite sides of the back of the collapsible chair. The locking pins are urged by compression springs to project outwardly from the locking collars and into removable locking engagement with the push button housings in the chair arms so as to hold the fold-down back in its locked upright position relative to the seat. A pushing force applied by the user to the push button plungers causes the plungers to move through the push button housings to correspondingly push the locking pins outwardly from the push button housings and inwardly through their locking collars against the normal bias of the compression springs to permit the fold-down back to be rotated to its unlocked folded position relative to the seat.

BRIEF DESCRIPTION OF THE DRAWINGS

FIG. 18 shows the lock release assembly of FIG. 17 accessible at one of the arms of the collapsible chair with the fold-down back locked in its upright position standing vertically from the seat of the chair;

FIG. 19 is a cross-section of an enlarged detail of a combined push button housing and push button plunger of the lock release assembly taken from FIG. 18;

FIG. 20 shows a back rest support for the fold-down chair back of FIG. 17 with the lock release assembly carried by side brackets that are affixed at opposite sides thereof;

FIG. 21 is a cross-section of an enlarged detail of a combined locking collar and locking pin of the lock release assembly taken from FIG. 20;

DESCRIPTION OF THE PREFERRED EMBODIMENT

Figure 1A:
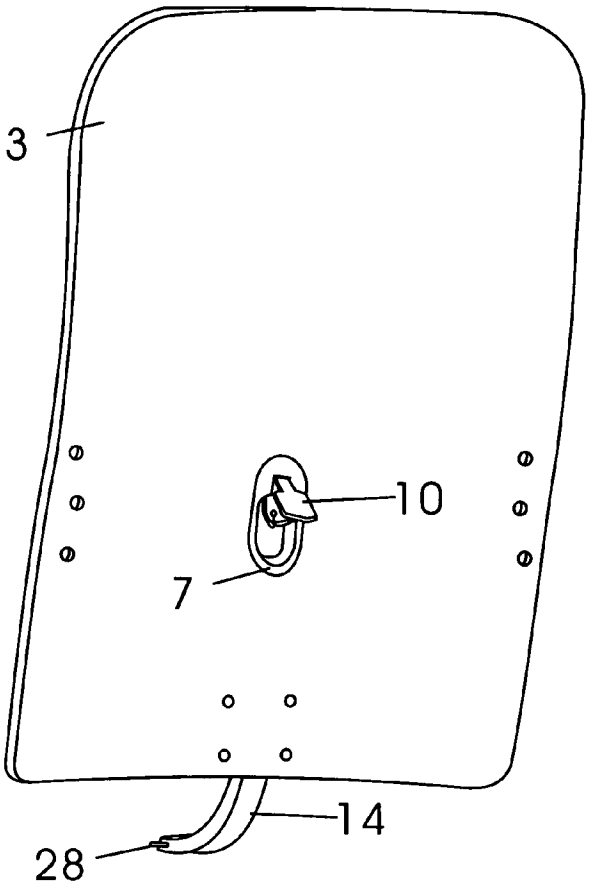
FIG. 1A shows the back rest support of FIG. 1 having a latch that is rotated to control the operation of the lock release assembly and the rotation of the fold-down back between the upright and folded positions.
Figure 1:
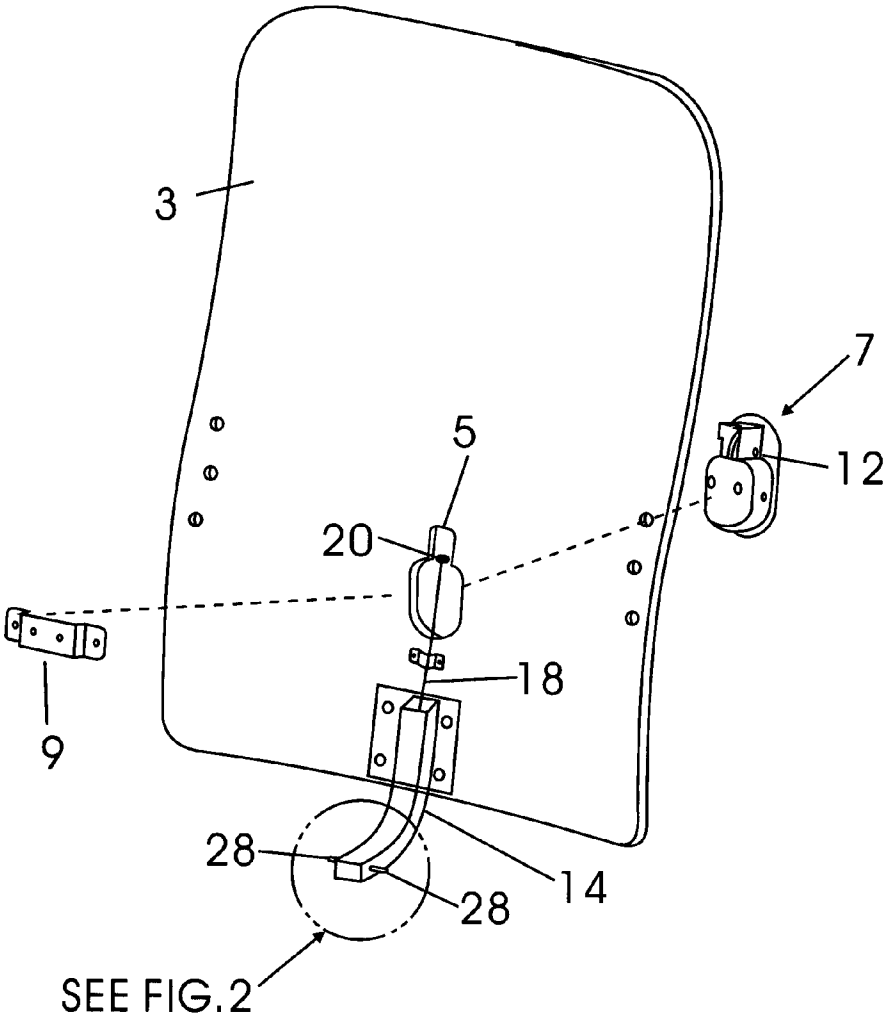
FIG. 1 is a perspective view of a back rest support having a lock release assembly for a fold-down back of a collapsible chair that is rotatable between upright and folded positions according to a first preferred embodiment of the present invention.
Figure 3:
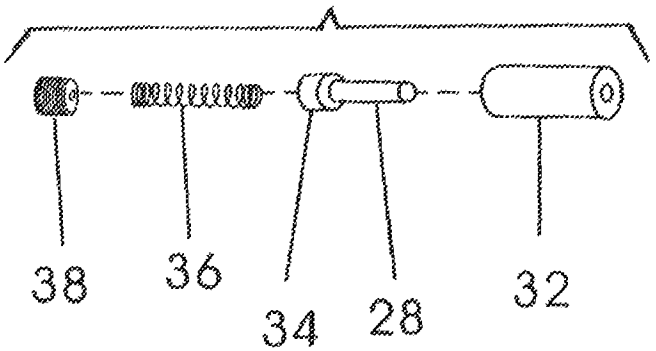
FIG. 3 is an exploded view showing other details of the lock release assembly of FIG. 1.
Figure 2:
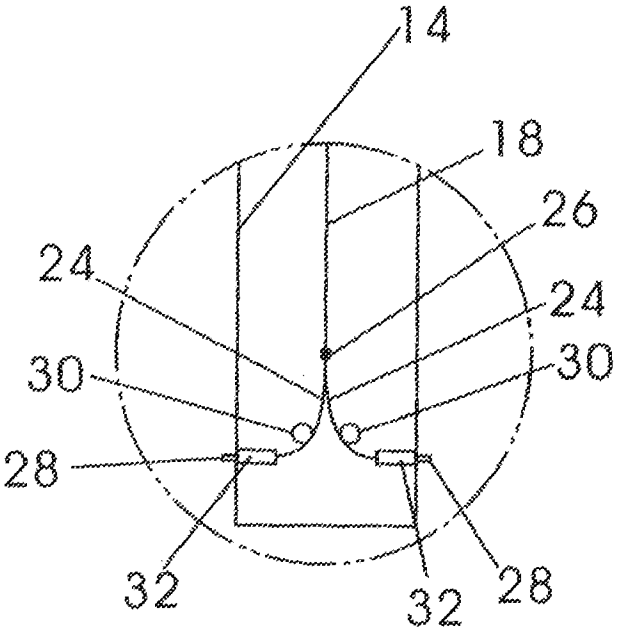
FIG. 2 is an enlarged detail of the lock release assembly taken from FIG. 1.

A lock release assembly for a fold-down chair back (designated 1 in FIGS. 4-6) according to a first preferred embodiment of this invention is initially described while referring concurrently to FIGS. 1-3 of the drawings. FIG. 1 shows the front of a solid (e.g., plywood) back rest support 3 to be carried inside the upholstered fold-down back 1 of a collapsible home or office chair (designated 40 in FIGS. 4-6). A housing cavity 5 is formed through the back rest support 3 for receipt of a latch housing 7. As will be explained in greater detail hereinafter, manual access is provided to a latch (designated 10 in FIG. 1A) that is pivotally coupled and rotatable relative to the latch housing 7 through the upholstery of the fold-down chair back 1 so that a user can selectively control the rotation of the fold-down back from a locked upright position to an unlocked folded position.

In the assembled relationship shown in FIG. 1A, the latch housing 7 is located within the housing cavity 5 at the rear of the back rest support 3 so as to be easily accessible to the user at the rear of the fold-down chair back 1. A latch retention bracket 9 (of FIG. 1) is affixed to the front of back rest support 3 so as to extend across the housing cavity 5 to engage the latch housing 7 and prevent a removal of the latch housing from housing cavity 5.

The latch 10 may be identical to the latch that is shown and described in patent application Ser. No. 12/315,163, the details of which are incorporated herein by reference. Therefore, only a brief description of the latch 10 and its pivotal connection to the latch housing 7 will be described in this application. The latch 10 has a coupling sleeve (not shown) which is axially aligned with a pair of pin holes (only one of which 12 being visible in FIG. 1) that are formed through the latch housing 7. A coupling pin (also not shown) is pushed through the pin holes 12 of housing 7 and the coupling sleeve of the latch 10 that is located therebetween, whereby the latch is rotatable between an at-rest position (best shown in FIG. 4) located inwardly of the latch housing 7 and a raised position (best shown in FIG. 5) extending outwardly from the latch housing 7. The latch 10 is interfaced with a spring inside the latch housing 7 so that the latch will automatically be pulled (i.e., rotated) towards its at-rest position.

A hollow, arcuate-shaped back bar 14 is affixed at one end thereof to the front of the back rest support 3. The opposite end of the back bar 14 is slidably and removably received by a seat back coupling channel 16 (of FIGS. 4-6) that is mounted below the seat 42 of the collapsible chair 40. A cable 18 that is responsive to a manual pulling force applied by the user to the latch 10 runs through the hollow back bar 14. One end of the cable 18 terminates at a cable terminal 20. The cable terminal 20 is attached to the latch 10 so that the cable will undergo tension when the latch is rotated to its raised position (of FIG. 5).

As is best shown in FIG. 2, the opposite end of the cable 18 is joined to a pair of locking cables 24 at a cable splice 26. The locking cables 24 run between the splice 26 and a corresponding pair of retractable locking pins 28 by way of respective cable guides 30. The locking pins 28 project outwardly and in opposite directions from the back bar 14 so as to be removably received by respective pin holes 29 (of FIGS. 4-6) that are formed in the seat back coupling channel 16 through which the back bar 14 is slidable.

As is best shown in FIG. 3, each retractable locking pin 28 is slidable through and surrounded by a cylindrical bushing 32. The bushings 32 are affixed (e.g., welded) inside the hollow back bar 14 so that the locking pins 28 which project from the back bar 14 will be aligned for receipt by the pin holes 29 of coupling channel 16. Each locking pin 28 has a relatively wide head 34. A (e.g., coiled) compression spring 36 is located inside the bushing 32 so as to lie between the pin head 34 and a stationary screw-threaded locking plug 38. The threaded locking plug 38 is rotated into engagement with a correspondingly threaded end of the bushing 32. One of the pair of locking cables 24 of FIG. 2 is connected (e.g., welded) to the pin head 34 of the locking pin 28 of FIG. 3 by way of a hole in the locking plug 38 and the coils of the compression spring 36.

Figure 4:
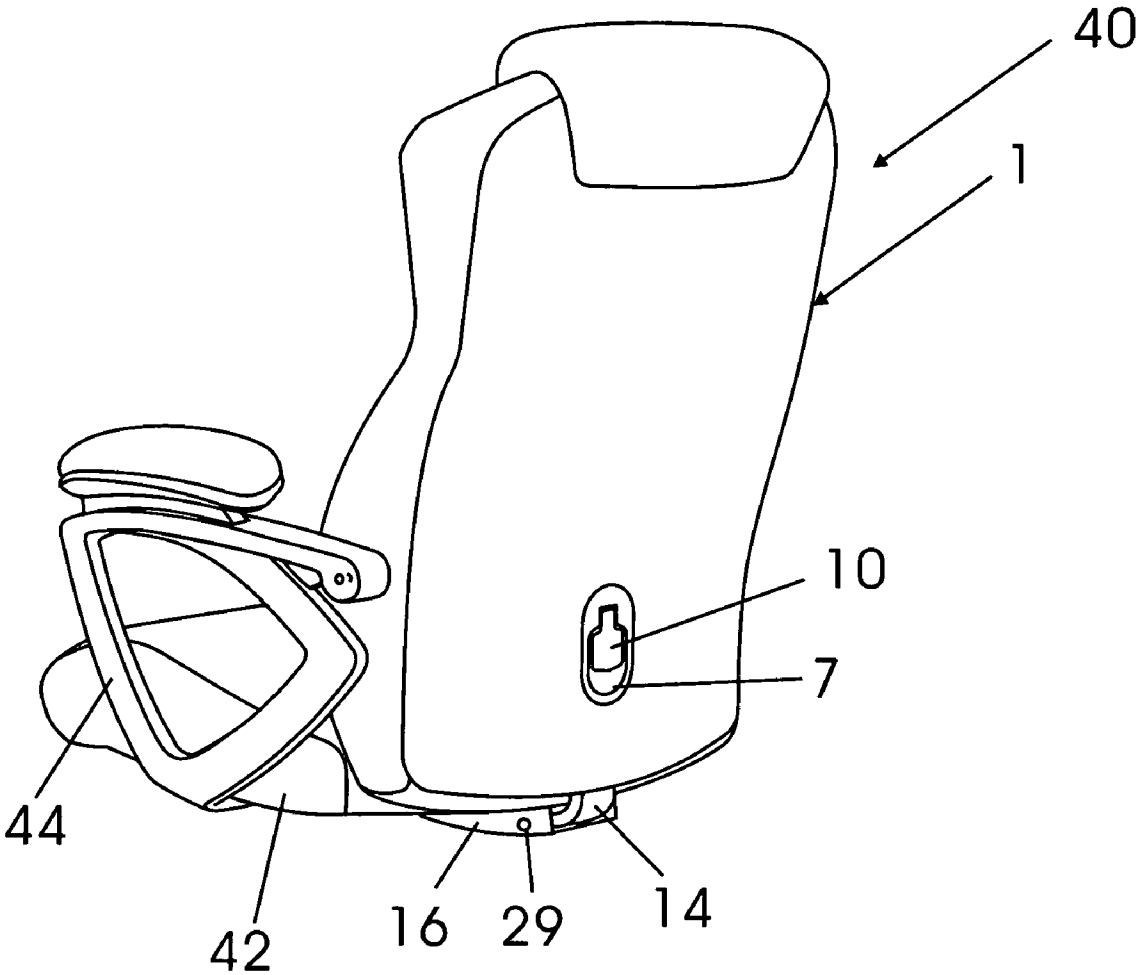
FIG. 4 shows the fold-down back of the collapsible chair locked in the upright position standing vertically from the seat of the chair.
Figure 5:
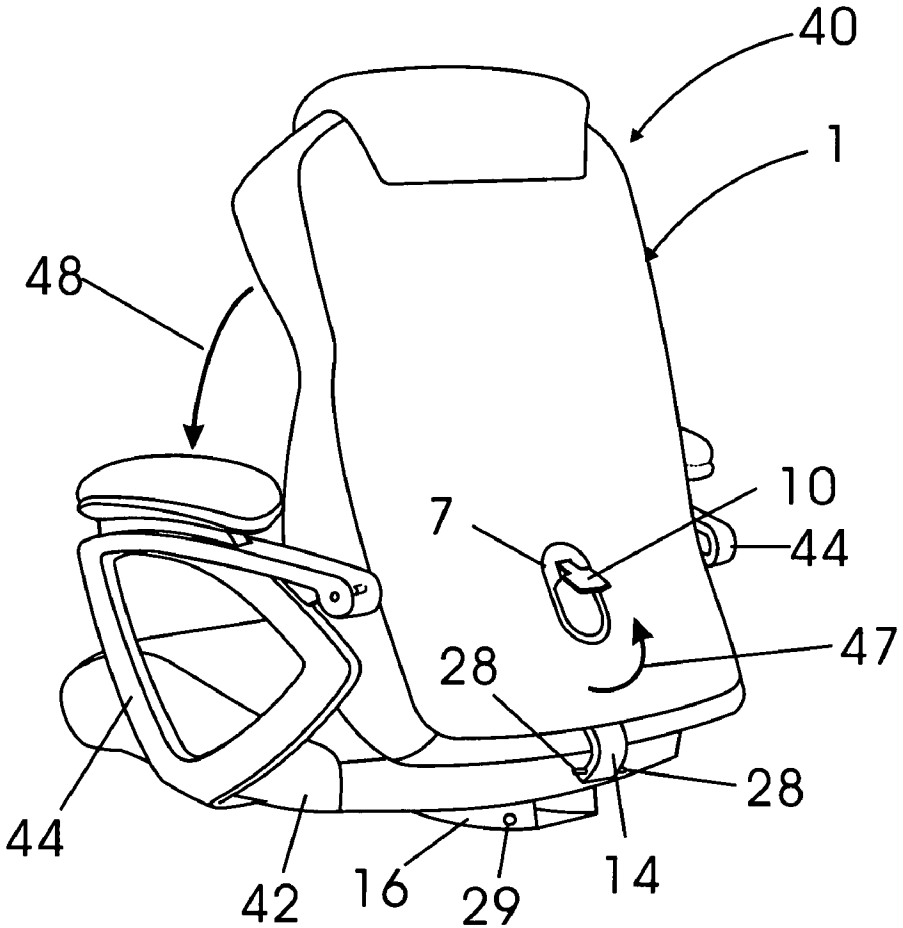
FIG. 5 shows the latch of the lock release assembly being rotated to permit the fold-down back to be unlocked and rotated towards the seat of the collapsible chair.
Figure 6:
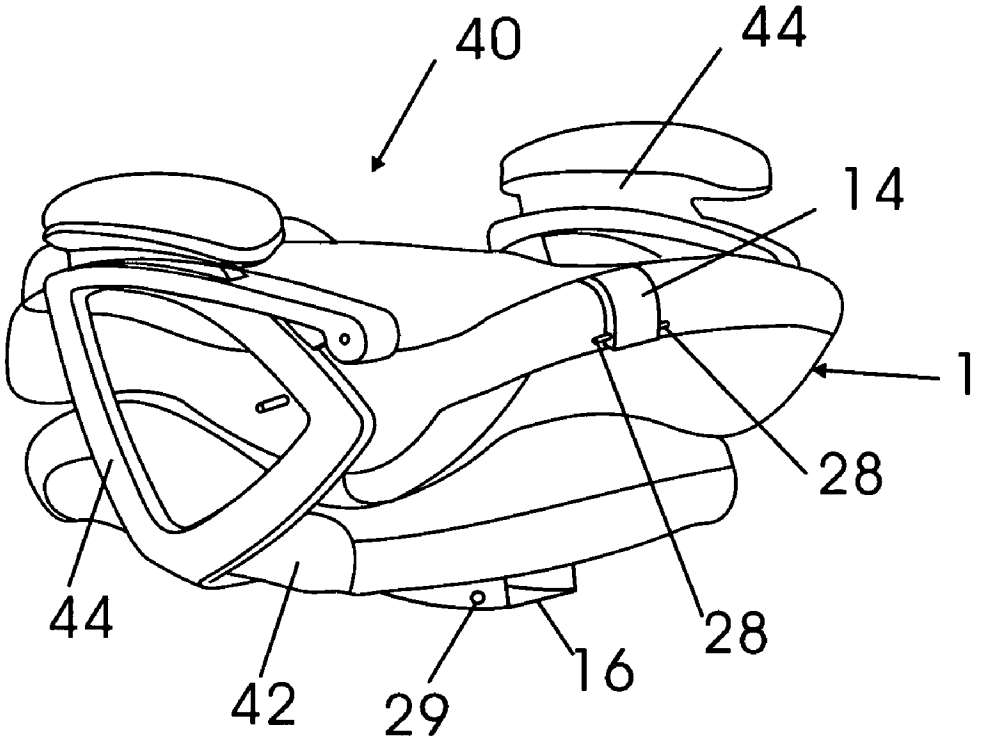
FIG. 6 shows the fold-down back of the collapsible chair after the back is rotated to its folded position lying horizontally over the seat of the chair.

The manual manipulation of the latch 10 that is accessible at the rear of the fold-down back 1 of the collapsible chair 40 for enabling the back 1 to rotate between its upright and folded positions is now described while referring to FIGS. 4-6 of the drawings. FIG. 4 shows the fold-down chair back 1 in the locked upright position standing vertically from the seat 42 of chair 40. The back 1 is pivotally connected between a pair of chair arms 44 that lie at opposite sides of seat 42 by pivot means which may be identical to that shown and described in U.S. Pat. No. 6,786,553. With the fold-down back 1 in its locked upright position, the latch 10 will be at rest within latch housing 7, and the cable 18 (of FIG. 1) which is attached to latch 10 is relaxed (i.e., under no tension). Accordingly, each retractable locking pin 28 at the end of a locking cable 24 (of FIG. 2) is urged (by a spring 36) outwardly from the back bar 14 and into removable receipt by a pin hole 29 of the seat back coupling channel 16 mounted below seat 42.

When the user applies a lifting force thereto, the latch 10 will rotate (in the direction of the reference arrow 47 of FIG. 5) from its initial at-rest position to its raised position extending outwardly from the latch housing 7. A rotation of latch 10 causes a corresponding pulling force to be applied to the cable 18 so that the cable is now stressed (i.e., subjected to tension). The pulling force is transferred from cable 18, first to the pair of locking cables 24, and then to the retractable locking pins 28 within bushings 32. Accordingly, the locking pins 28 are retracted from the pin holes 29 in the seat back coupling channel 16 and withdrawn inwardly through their bushings 32. The springs 36 that are located between the pin heads 34 and the locking plugs 38 will be compressed and store energy.

With the locking pins 28 removed from pin holes 29, the fold-down back 1 of the collapsible chair 40 can be rotated (in the direction of the reference arrow 48 of FIG. 5) from the locked upright position of FIG. 4 to the unlocked folded position of FIG. 6 so as to lie horizontally over and in face-to-face alignment with the seat 42. At the same time, the back bar 14 that is carried by the chair back 1 is released by and pulled outwardly from coupling channel 16 below the seat 42. Once the fold-down back 1 is rotated to its folded position, the pulling force applied to the latch 10 and the cable 18 is terminated. The springs 36 will release their stored energy and expand against the stationary locking plugs 38, whereby to urge the locking pins 28 to move through bushings 32 so as to be ready to automatically snap into receipt by the pin holes 29 in coupling channel 16 when the chair back 1 is returned to its upright position. The collapsible chair 40 with the fold-down back 1 rotated as shown in FIG. 6 is now in a space-efficient, compact configuration that is ideally suited for either transport or storage.

Figure 7:
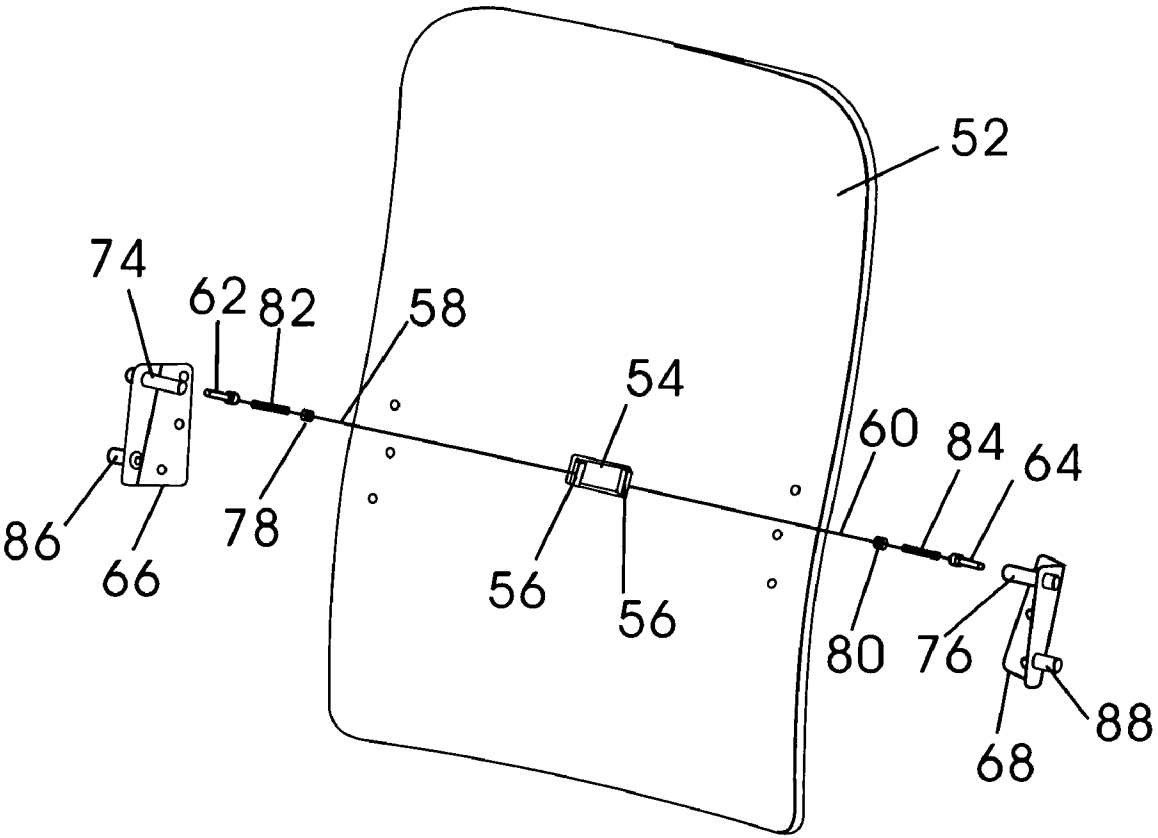
FIG. 7 is a perspective view of a back rest support having a lock release assembly for a fold-down back of a collapsible chair that is rotatable between upright and folded positions according to a second preferred embodiment of the present invention.
Figure 8:
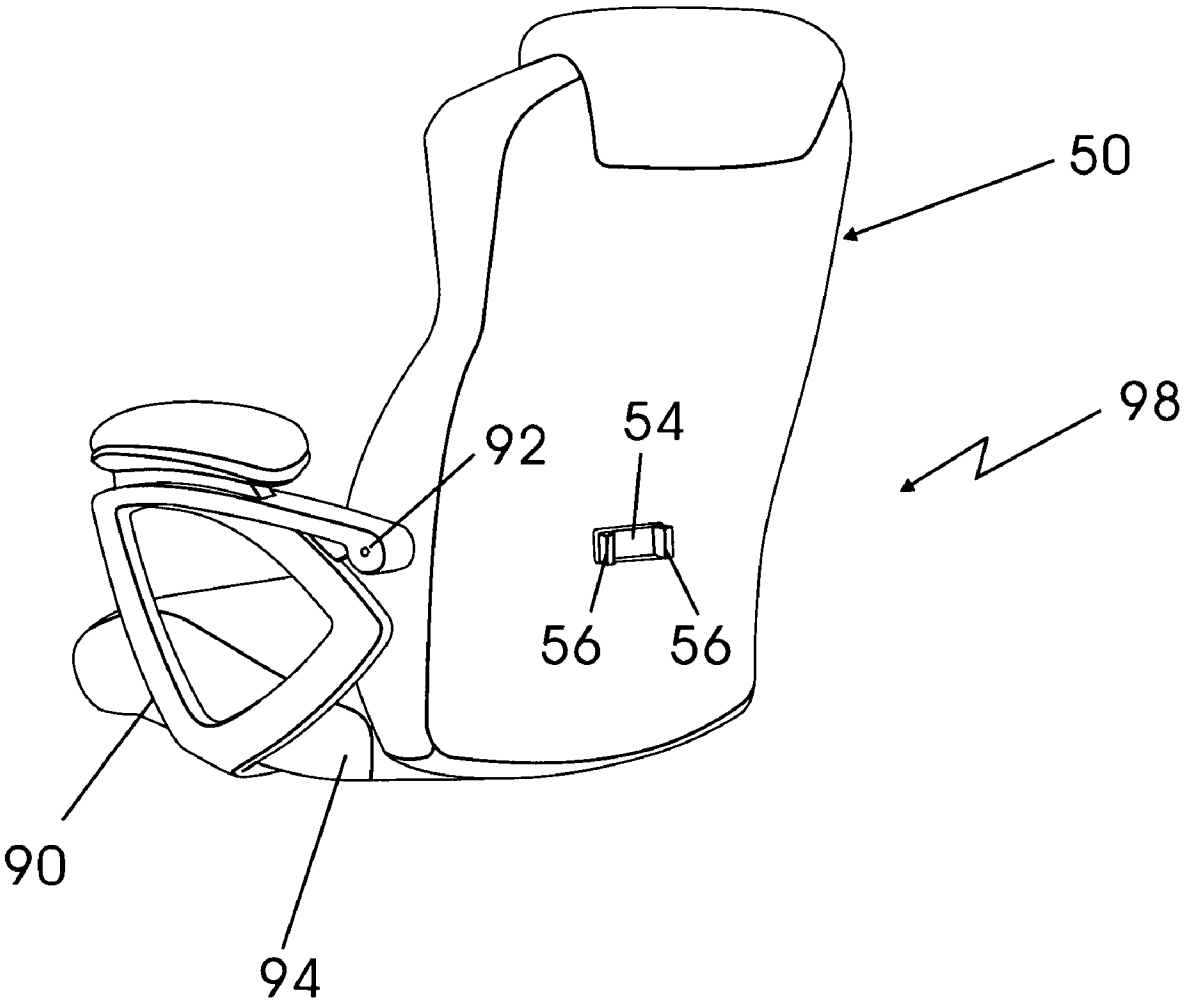
FIG. 8 shows pull tabs of the lock release assembly of FIG. 7 accessible at the rear of the fold-down chair back with the back locked in the upright position standing vertically from the seat of the chair.
Figure 9:
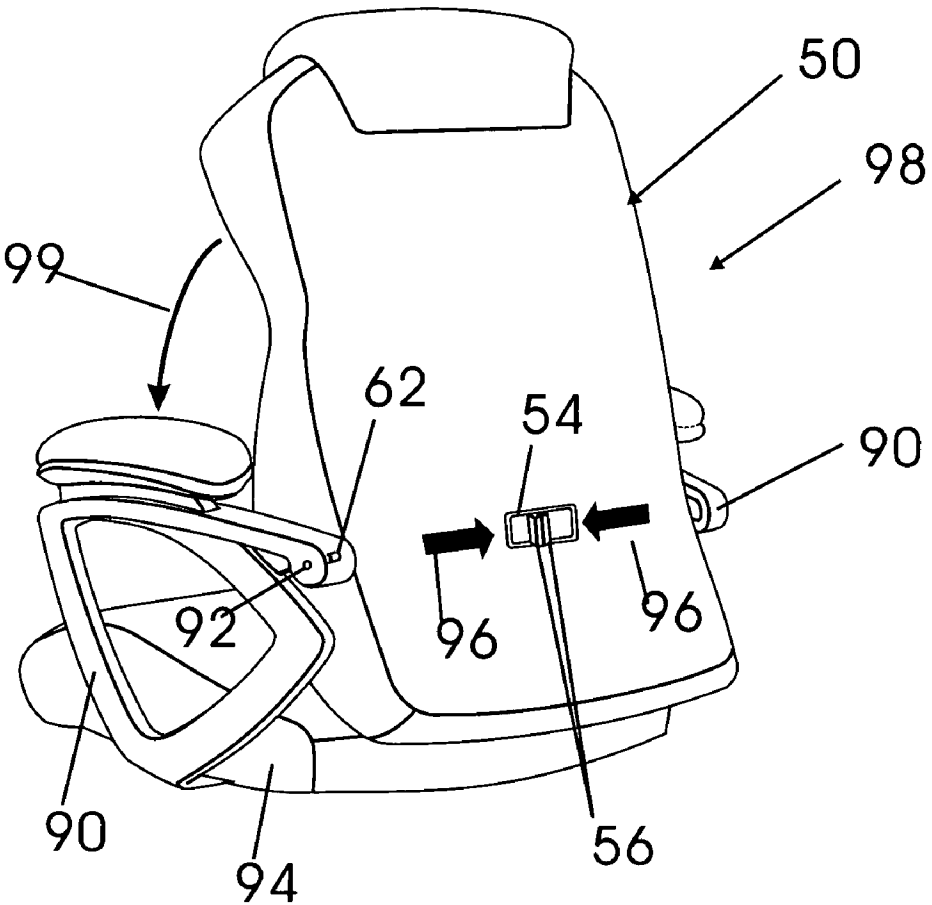
FIG. 9 shows the pull tabs of the lock release assembly being squeezed together to permit the fold-down back to be unlocked and rotated towards the seat of the collapsible chair.
Figure 10:
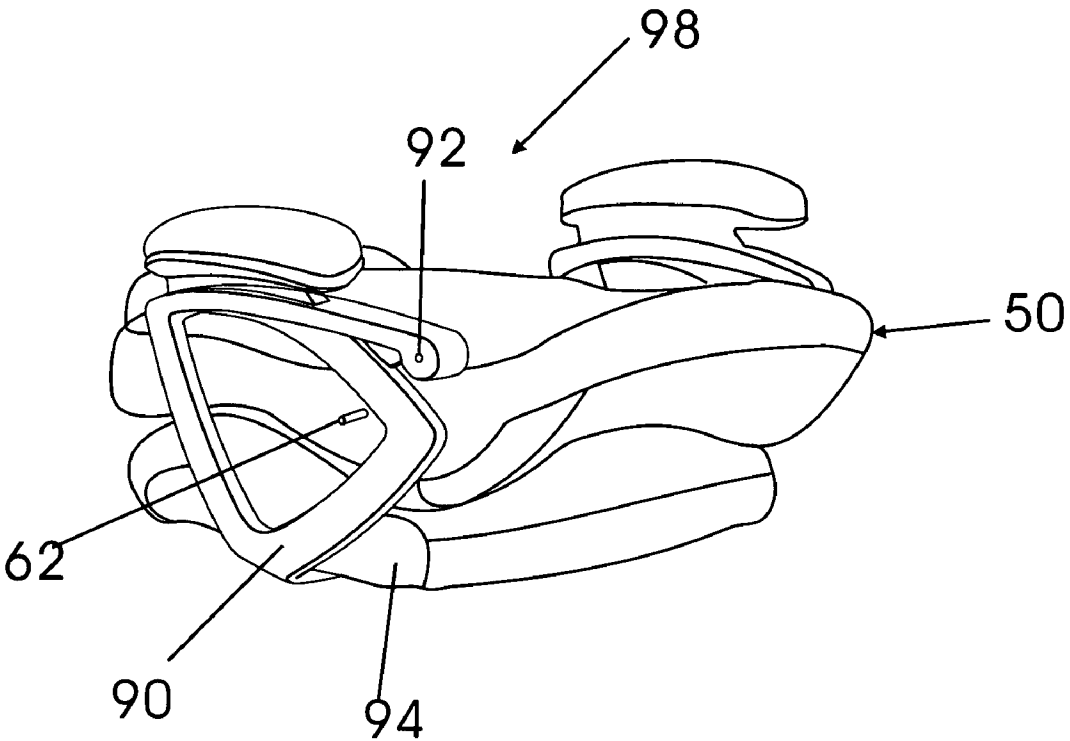
FIG. 10 shows the fold-down back of the collapsible chair after the back is rotated to its folded position lying horizontally over the seat of the chair.

A lock release assembly for a fold-down chair back (designated 50 in FIGS. 8-10) according to a second preferred embodiment of this invention is initially described while referring to FIG. 7 where the front of a solid (e.g., plywood) back rest support 52 is shown to be carried inside the upholstered fold-down back of a collapsible home or office chair (designated 98 in FIGS. 8-10). A pull tab cavity 54 is formed through the back rest support 52 for receipt therethrough of a pair of pull tabs 56 that are slidable towards and away from one another along the cavity 54. As will be explained in greater detail hereinafter, manual access to the pull tabs 56 is provided through the upholstery of the fold-down back 50 of the collapsible chair 98 within which the back rest support 52 is located so that a user can selectively control the rotation of the fold-down back 50 from a locked upright position to an unlocked folded position.

First ends of a pair of locking cables 58 and 60 are connected to respective ones of the pair of pull tabs 56 within the pull tab cavity 54. Opposite ends of the pair of locking cables 58 and 60 are connected (e.g., welded) to respective retractable locking pins 62 and 64. The locking cables 58 and 60 run laterally along the front of the back rest support 52 between pull tabs 56 and locking pins 62 and 64.

A pair of L-shaped side brackets 66 and 68 are connected to opposite sides of the front of the back rest support 52 at mounting holes formed therein. Each of the side brackets 66 and 68 includes a hollow locking collar 74 and 76 that is sized for the slidable receipt therethrough of one of the retractable locking pins 62 and 64. Stationary screw-threaded locking plugs 78 and 80 are rotated into engagement with correspondingly threaded portions of each of the locking collars 74 and 76 of side brackets 66 and 68. A hole extends through each locking plug 78 and 80 to accommodate one of the locking cables 58 and 60. Located inside the locking collars 74 and 76 between a relatively wide head of each locking pin 62 and 64 and a locking plug 78 and 80 is a (e.g., coiled) compression spring 82 and 84.

Each of the side brackets 66 and 68 also includes a pivot post 86 and 88 lying below the locking collars 74 and 76. The pivot posts 86 and 88 project outwardly from the side brackets 66 and 68 to be pivotally coupled to the arms 90 of the collapsible chair 98, whereby the pivot posts establish pivot axes at which the fold-down back 50 is rotatable between its locked upright position of FIG. 8 and its unlocked folded position of FIG. 10.

When the chair back 50 is in its upright position of FIG. 8, the pull tabs 56 are separated from one another at opposite ends of the pull tab cavity 54, the locking cables 58 and 60 (of FIG. 7) are relaxed (i.e., they are under no tension), and the retractable locking pins 62 and 64 are urged by compression springs 82 and 84 so as to extend outwardly from the locking collars 74 and 76 of side brackets 66 and 68. In this case, the outwardly-extending locking pins 62 and 64 are removably received by locking pin holes (only one of which 92 being shown in FIGS. 8-10) that are formed in each of the pair of arms 90 of the collapsible chair 98. When the locking pins 62 and 64 are located within the pin holes 92, the fold-down back 50 is held in the upright position standing vertically above the seat 94 of chair 98. That is to say, the fold-down back 50 cannot be rotated at the pivot posts 86 and 88 of side brackets 66 and 68 of FIG. 7 from the upright position to the folded position.

When it is desirable to rotate the fold-down chair back 50 to its folded position of FIG. 10, the user applies a compressive force (in the direction of the reference arrows 96 of FIG. 9) to squeeze the pull tabs 56 towards one another along the pull tab cavity 54 at the rear of the chair back 50. In this case, a pulling force is applied to the locking cables 58 and 60 (of FIG. 7) which are connected to the pull tabs 56, whereby the locking cables are stressed and subjected to tension. Accordingly, the locking pins 62 and 64 will be pulled by the locking cables 58 and 60 so as to be retracted from the locking pin holes 92 in chair arms 90 and slide inwardly through the locking collars 74 and 76 of the side brackets 66 and 68 towards the locking plugs 78 and 80. Inasmuch as the locking plugs 78 and 80 are stationary, the compression springs 82 and 84 within locking collars 74 and 76 will be compressed between the heads of the locking pins 62 and 64 and the locking plugs 78 and 80.

Once the locking pins 62 and 64 are retracted (i.e., removed) from the locking pin holes 92, the chair back 50 is free to be rotated at the pivot posts 86 and 88 (in the direction of the reference arrow 99 of FIG. 9) from its locked upright position of FIG. 8 to its folded position of FIG. 10 so as to lie horizontally over and in face-to-face alignment with the chair seat 94. The collapsible chair 98 with the fold-down back 50 rotated as shown in FIG. 10 is now in a space-efficient, compact configuration that is ideally suited for either transport or storage.

After the fold-down back 50 has been rotated to its folded position, the compressive squeezing force applied to the pull tabs 56 of FIG. 9 is terminated such that the pulling force applied to the locking cables 58 and 60 is also terminated. At this time, the compression springs 82 and 84 will expand against the stationary locking plugs 78 and 80, whereby to drive the formerly retracted locking pins 62 and 64 in an opposite direction through their respective locking collars 74 and 76 of side brackets 66 and 68 so that the locking pins are automatically returned to their original position extending outwardly from the locking collars to be ready to pop into removable receipt by the locking pin holes 92 in chair arms 90 when the chair back 50 is rotated at pivot posts 86 and 88 back to is upright position.

Figure 12A:
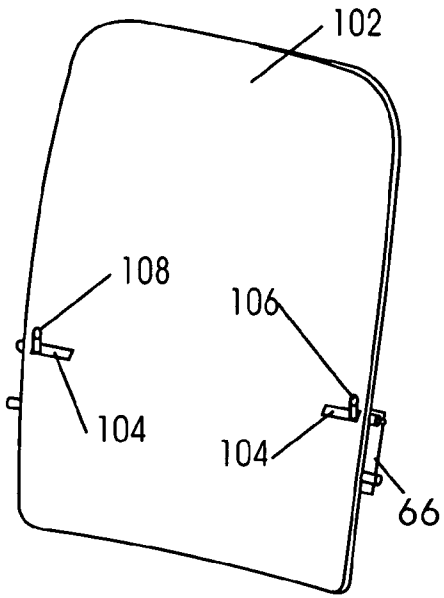
FIG. 12A shows the rear of the back rest support of FIG. 12 with finger levers of the lock release assembly projecting through finger lever slots formed therein.
Figure 12:
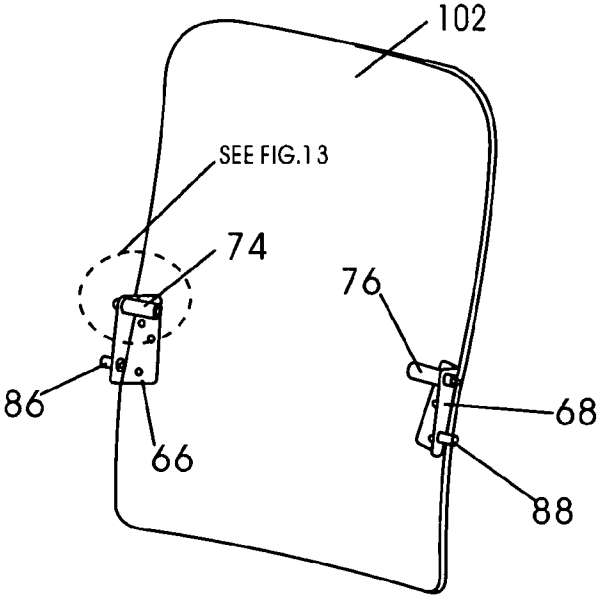
FIG. 12 shows the front of the back rest support of FIG. 11 with the lock release assembly carried by side brackets affixed at opposite sides thereof.
Figure 13A:
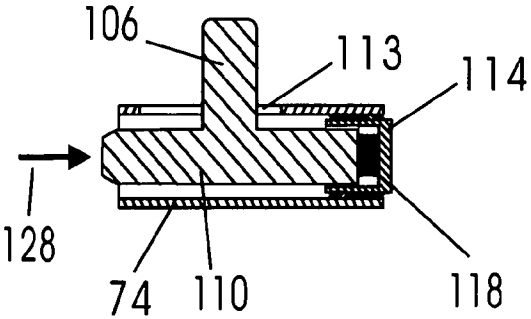
FIG. 13A is a cross-section of the combined finger lever and locking pin of FIG. 13 in an unlocked configuration.
Figure 13:
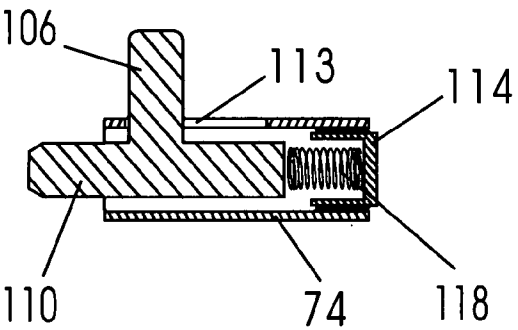
FIG. 13 is a cross-section of an enlarged detail of a combined finger lever and locking pin of the lock release assembly in a locked configuration taken from FIG. 12.
Figure 14:
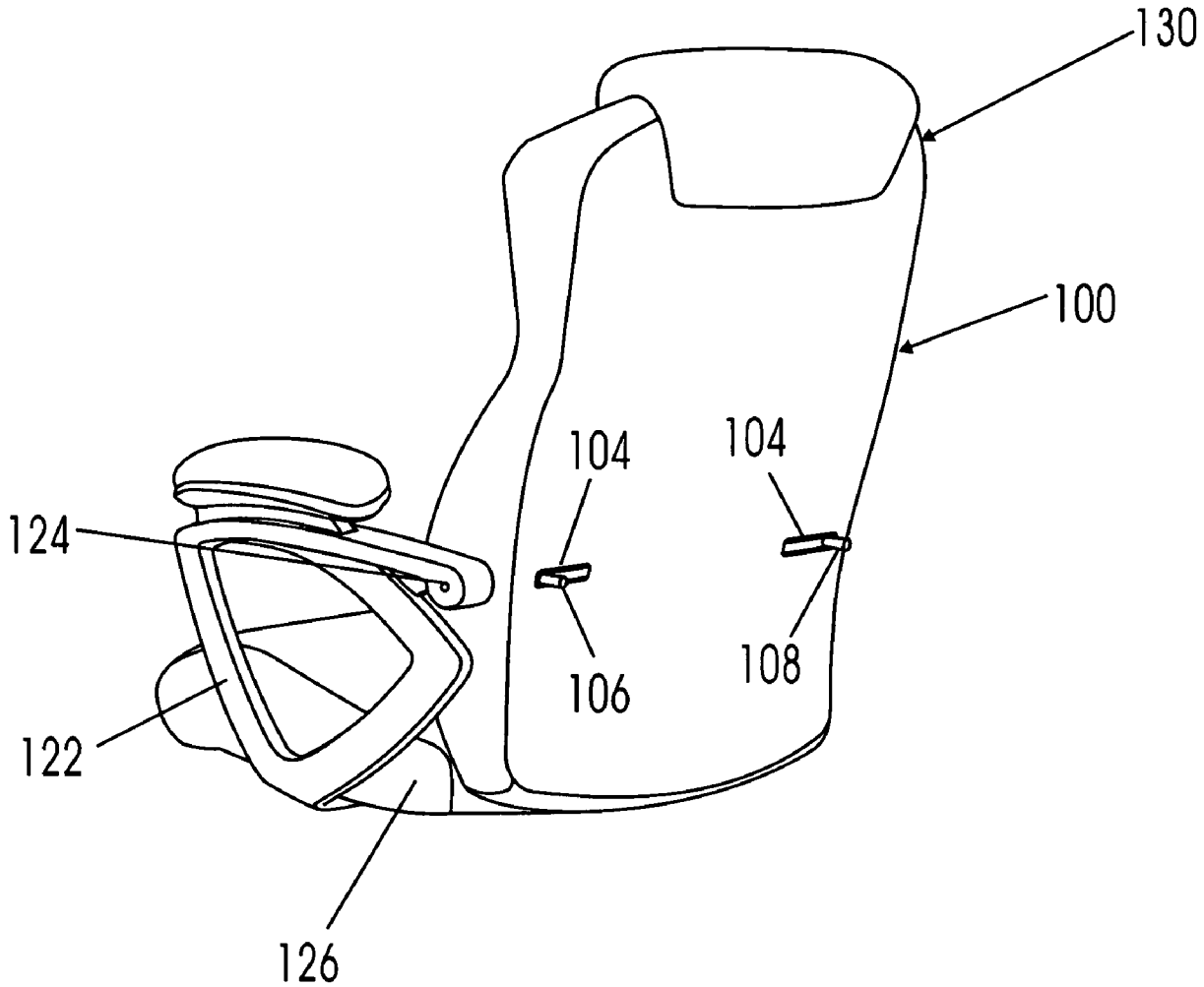
FIG. 14 shows the lock release assembly of FIG. 11 accessible at the rear of the fold-down chair back with the back locked in its upright position standing vertically from the seat of the chair.
Figure 15:
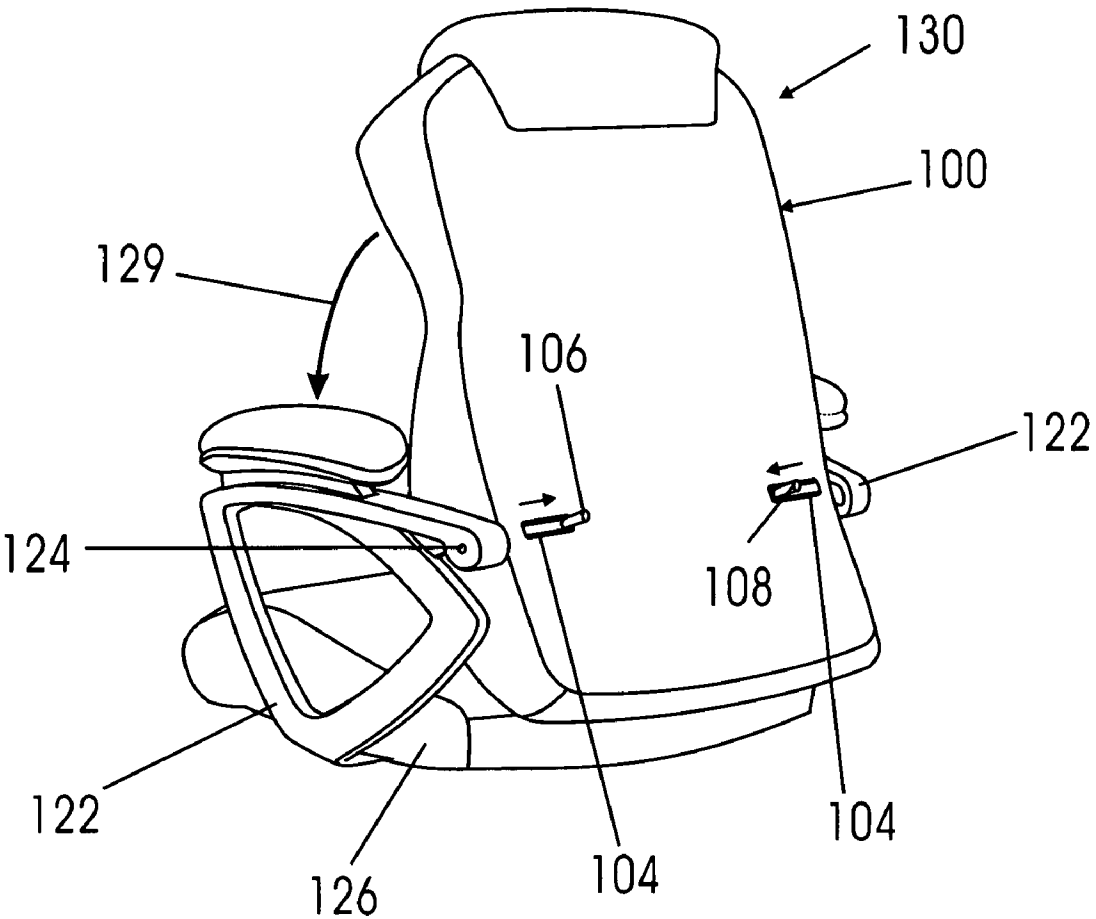
FIG. 15 shows the finger levers of the lock release assembly being pushed together to permit the fold-down back to be unlocked and rotated towards the seat of the collapsible chair.
Figure 16:
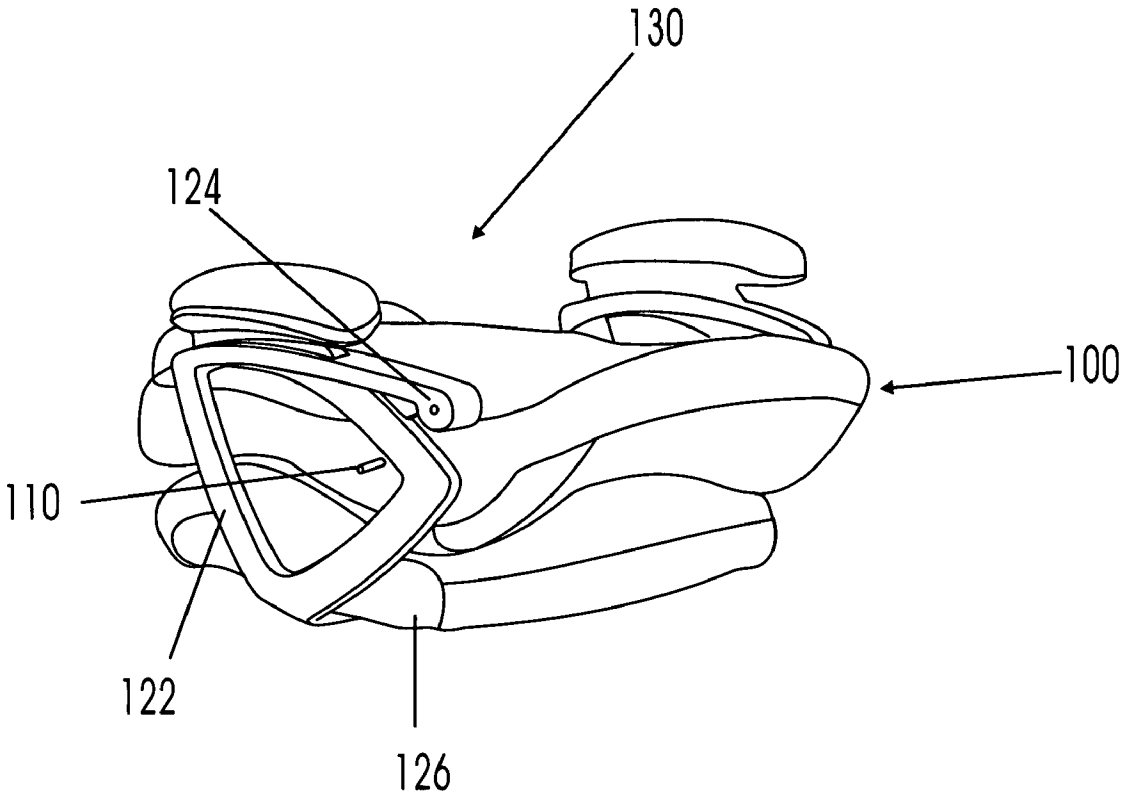
FIG. 16 shows the fold-down back of the collapsible chair after the back is rotated to its folded position lying horizontally over the seat of the chair.

A lock release assembly for a fold-down chair back (designated 100 in FIGS. 14-16) according to a third preferred embodiment of this invention is initially described while referring to FIGS. 11-13A of the drawings where a solid (e.g., plywood) back rest support 102 is shown to be carried inside the upholstered back of a collapsible home or office chair (designated 130 in FIGS. 14-16). A finger lever slot 104 is formed through each side of the back rest support 102 for receipt therethrough of respective finger levers 106 and 108 that are affixed (e.g., welded) to and stand outwardly from retractable locking pins 110 and 112 (best shown in FIG. 12A).

As will be explained in greater detail hereinafter, the finger levers 106 and 108 are slidable towards and away from one another along the finger lever slots 104. As will also be explained, manual access to the finger levers 106 and 108 is provided through the upholstery of the fold-down back 100 of the collapsible chair 130 within which the back rest support 102 is located so that a user can selectively control the rotation of the fold-down back 100 from a locked upright position to an unlocked folded position.

Figure 11:
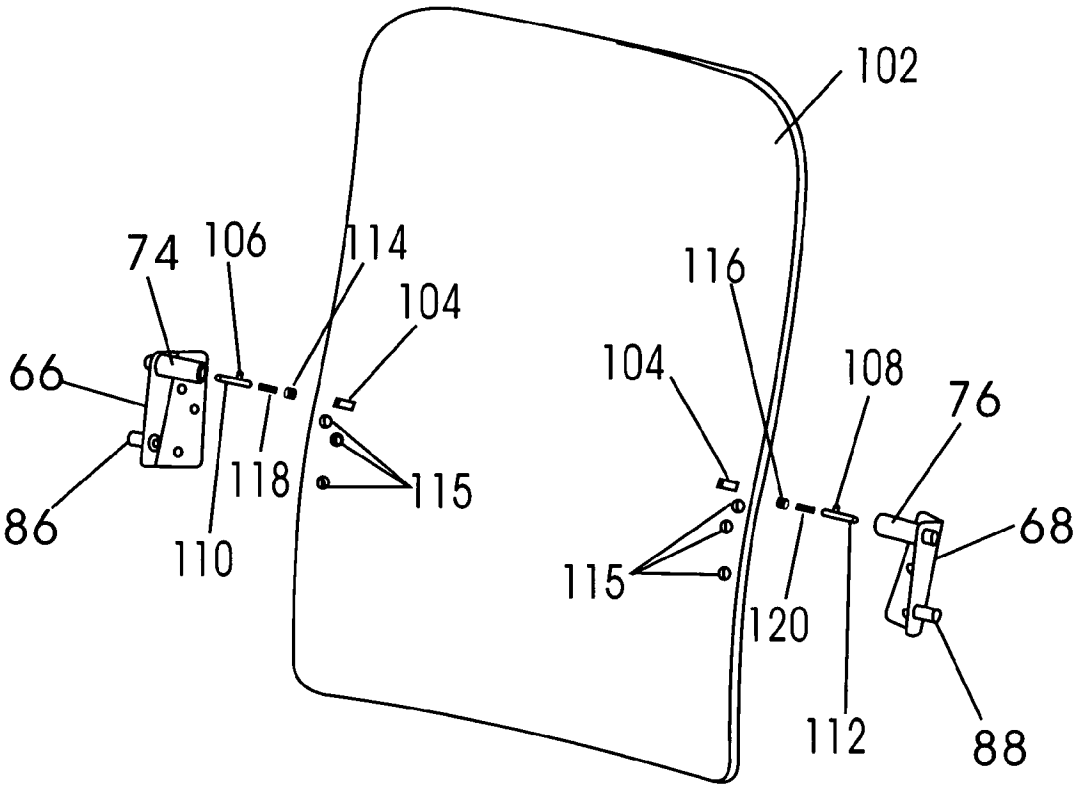
FIG. 11 is a perspective view of a back rest support having a lock release assembly for a fold-down back of a collapsible chair that is rotatable between upright and folded positions according to a third preferred embodiment of the present invention.

A pair of L-shaped side brackets 66 and 68 are connected to opposite sides of the front of the back rest support 102 shown in FIGS. 11 and 12 by means of fasteners (not shown) that are connected to the side brackets 66 and 68 through mounting holes 115 formed in the back rest support 102. The side brackets 66 and 68 shown in FIGS. 11 and 12 may be identical to those shown in FIG. 7. Therefore, identical reference numerals will be used to describe the identical features of the same side brackets 66 and 68 in FIGS. 11 and 12.

Each of the side brackets 66 and 68 includes a hollow locking collar 74 and 76 that is sized for the slidable receipt therethrough of one of the retractable locking pins 110 and 112. In order to generate the force necessary to cause the locking pins (e.g., 110) to slide through their locking collars (e.g., 74), the finger levers (e.g., 106) which are affixed to and stand outwardly from the locking pins are slidably received through guide slots 113 which run axially along the locking collars (best shown in FIG. 13). Stationary screw-threaded locking plugs 114 and 116 are rotated into engagement with a correspondingly threaded end of each of the locking collars 74 and 76 (also best shown in FIG. 13). Located within the locking collars 74 and 76 between each of the locking pins 110 and 112 and a locking plug 114 and 116 is a (e.g., coiled) compression spring 118 and 120. Each of the side brackets 66 and 68 also includes a pivot post 86 and 88 lying below the locking collars 74 and 76. The pivot posts 86 and 88 project outwardly from the side brackets 66 and 68 to be pivotally coupled to the arms 122 of the collapsible chair 130 of FIGS. 14-16, whereby the pivot posts 86 and 88 establish pivot axes at which the fold-down back 100 is rotatable between its locked upright position of FIG. 14 and its unlocked folded position of FIG. 16.

When the chair back 100 is in its locked upright position of FIG. 14, the finger levers 106 and 108 that are affixed to the retractable locking pins 110 and 112 are separated from one another at outermost ends of the finger lever slots 104. In this case, the compression springs (e.g., 118 of FIG. 13) within the locking collars (e.g., 74) of side brackets 66 and 68 are relaxed and expanded, such that each locking pin (e.g., 110) is urged by the spring 118 to extend outwardly from its locking collar 74 to be removably received by a locking pin hole (designed 124 in FIGS. 14-16) that is formed in one of the pair of arms 122 of the collapsible chair 130. When the locking pins 110 and 112 (of FIG. 11) are located within the locking holes 124, the fold-down back 100 is held in the upright position standing vertically above the seat 126 of chair 130. That is to say, the fold-down back 100 cannot be rotated at the pivot posts 86 and 88 of side brackets 66 and 68 from the upright position to the folded position.

When it is desirable to rotate the fold-down chair back 100 to its folded position of FIG. 16, the user applies inward pushing forces against the finger levers 106 and 108. In this case, the finger levers 106 and 108 ride through the guide slots 113 (of FIG. 13) which are formed in the locking collars (e.g., 74) so as to move towards one another at the innermost ends of the finger lever slots 104 at the rear of the fold-down back 100 as shown in FIG. 15. Accordingly, the retractable locking pins (e.g., 110) to which the finger levers 106 and 108 are affixed will be correspondingly pushed in the direction of the reference arrow 128 of FIG. 13A through the locking collars (e.g., 74) of the side brackets 66 and 68 so as to be retracted from the locking pin holes 124 in the chair arms 122. Inasmuch as the locking plugs (e.g., 114) within the locking collars are stationary, each of the compression springs (e.g., 118) which lies between locking pin 110 and locking plug 114 will be compressed (best shown in FIG. 13A).

Once the locking pins 110 and 112 are retracted (i.e., removed) from the locking pin holes 124, the chair back 100 is free to be rotated at the pivot posts 86 and 88 (in the direction of the reference arrow 129 of FIG. 15) from its locked upright position of FIG. 14 to its unlocked folded position of FIG. 16 so as to lie horizontally over and in face-to-face alignment with the chair seat 126. The collapsible chair 130 with the fold-down back 100 rotated as shown in FIG. 16 is now in a space-efficient, compact configuration that is ideally suited for either transport or storage.

After the fold-down back 100 has been rotated to its folded position, the pushing force applied to the finger levers 106 and 108 of FIG. 11 is terminated so that the compression springs 118 and 120 will expand against the stationary locking plugs 114 and 116, whereby to drive the formerly retracted locking pins 110 and 112 in an opposite direction through their respective locking collars 74 and 76 of side brackets 66 and 68. Thus, the locking pins 110 and 112 are automatically returned to their original position extending outwardly from the locking collars 74 and 76 so as to be ready to pop into removable receipt by the locking holes 124 in chair arms 122 when the chair back 100 is rotated at pivot posts 86 and 88 back to its upright position. Moreover, the finger levers 106 and 108 are simultaneously driven through the guide slots 113 in the locking collars 74 and 76 as shown in FIG. 13 and the finger lever slots 104 to the outermost ends thereof as shown in FIG. 14.

Figure 17:
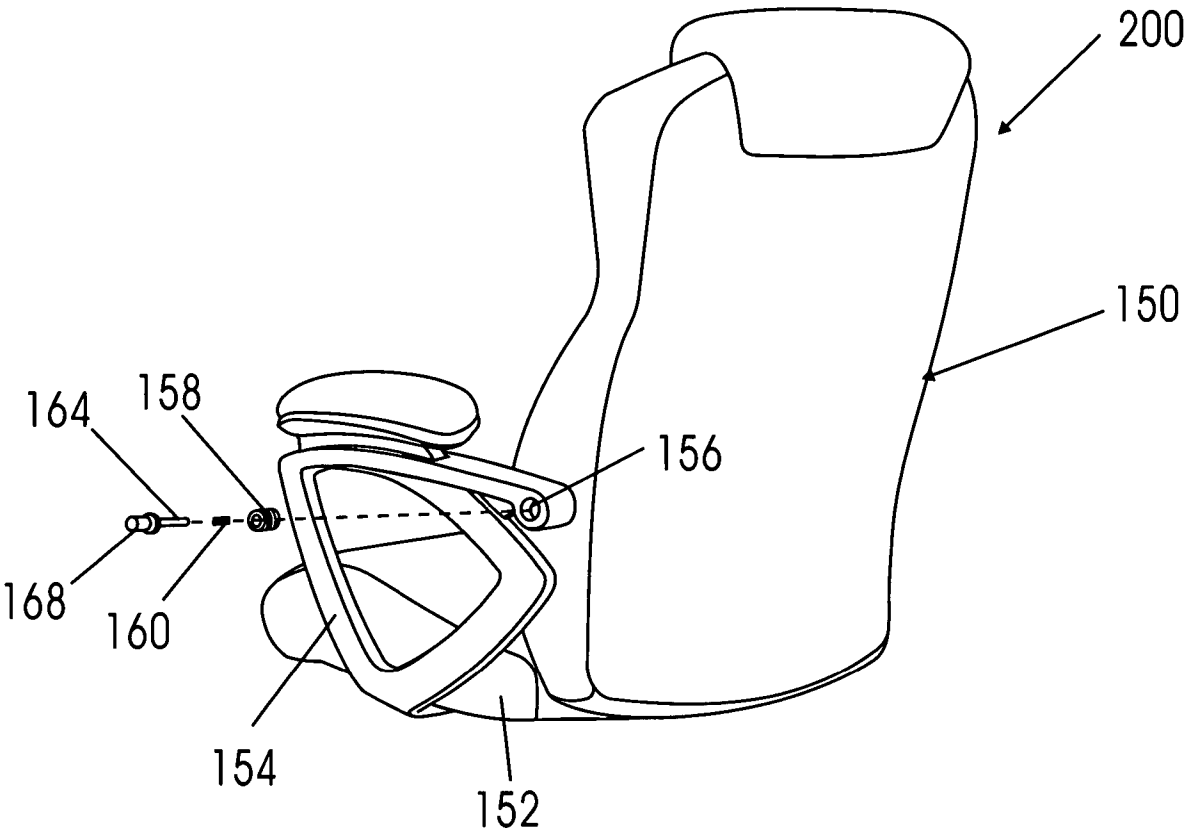
FIG. 17 is a perspective view of a a lock release assembly for a fold-down back of a collapsible chair that is rotatable between upright and folded positions according to a fourth preferred embodiment of the present invention.

A lock release assembly for a fold-down chair back 150 according to a fourth preferred embodiment of this invention is initially described while referring to FIGS. 17-19 of the drawings where there is shown a collapsible chair 200 including the fold-down back 150, a seat 152, and a pair of chair arms 154 located at opposite ends of the seat 152. The arms 154 of chair 200 are fixedly attached below the seat 152 and detachably connected to the chair back 150. By virtue of the foregoing, a user can selectively control the rotation of the fold-down back 150 relative to the seat 152 between a locked upright position standing vertically from the seat 152 of the collapsible chair 200 and an unlocked folded position lying horizontally over and in face-to-face alignment with the seat 152.

A threaded hole 156 is formed through each arm 156 (only one of which being visible in FIGS. 17 and 18) so as to lie adjacent one side of the chair back 152. A hollow, cylindrical threaded push button housing 158 is rotated into mating engagement with the chair arm 154 at the hole 156 formed therein. In the alternative, the push button housing 158 may have sharp edges that bite into and engage the arm 154 when housing 158 is rotated into the hole 156.

A compression (e.g., coil) spring 160 is located inside the hollow push button housing 158 so as to lie against a spring stop 162 which extends across the hole 156 in the chair arm 154 within which the housing 158 is affixed. As is best shown in FIG. 19, an elongated push button plunger 164 is slidably received by the push button housing 158 and surrounded by the compression spring 160. One end of the push button plunger 164 extends through an opening in the spring stop 162 for receipt at a force transmission cavity 166 that is located inside the hole 156 of the chair arm 154 and opposite a side of the fold-down chair back 150. A relatively wide push button head 168 is formed at the opposite end of the push button plunger 164 so as to be responsive to an inward pushing force applied thereto by the user in order to enable the chair back 150 to rotate from its locked upright position shown in FIGS. 17 and 18 to its folded position shown in FIG. 23. A retention lip 170 surrounds the push button plunger 164 below the push button head 168. The compression spring 160 which surrounds the push button plunger 164 extends between the spring stop 162 and the retention lip 170. The retention lip 170 abuts one end of the push button housing 158 so that plunger 164 is held within the push button housing when the compression spring 160 is relaxed and expanded as shown for exerting an outward pushing force against the push button head 168.

FIG. 20 of the drawings shows the front of a solid (e.g., plywood) back rest support 172 to be carried inside the upholstered fold-down back 150 of the collapsible chair 200. A pair of L-shaped side brackets 66 and 68 are connected to opposite sides of the back rest support 172 by means of fasteners (not shown). The side brackets 66 and 68 that are shown in FIG. 20 may be identical to those shown in FIGS. 7, 11 and 12. Therefore, identical reference numerals will be used to describe the common features of the same side brackets 66 and 68 in FIG. 20.

Referring in this regard to FIGS. 20 and 21 of the drawings, each of the side brackets 66 and 68 includes a hollow locking collar 74 and 76 that is sized for the slidable receipt therethrough of a retractable locking pin 176. A stationary screw-threaded locking plug 178 is rotated into engagement with a correspondingly threaded end of each locking collar (e.g., 76 of FIG. 21). Located within each locking collar 76 and extending between the locking plug 178 and a retaining lip 180 which surrounds the locking pin 176 is a (e.g., coiled) compression spring 182. With the compression spring 182 expanded and relaxed as shown in FIG. 21, a pushing force is exerted against the retention lip 182 to urge the retractable locking pin 176 to project outwardly from its locking collar 76. The retention lip 182 abuts the end of the locking collar 76 so that the locking pin 176 is held therewithin.

Each of the side brackets 66 and 68 also includes a pivot post 86 and 88 lying below the locking collars 74 and 76. The pivot posts 86 and 88 project outwardly from the side brackets 66 and 68 to be pivotally coupled to the arms 154 of the collapsible chair 200 of FIGS. 17, 18, 22 and 23, whereby the pivot posts 86 and 88 establish pivot axes at which the fold-down back 150 is rotatable between its locked upright position of FIG. 18 and its unlocked folded position of FIG. 23.

When the chair back 150 is in its locked upright position, the push button head 168 of each push button plunger 164 (of FIG. 19) is urged by compression spring 160 to project outwardly from the push button housing 158 that is affixed to the chair arm 154. At the same time, the retractable locking pin 176 (of FIG. 21) is urged by compression spring 182 to project outwardly from its locking collar 76 of side bracket 68, such that the locking pin 176 will be axially aligned with the push button plunger 164 inside the force-transmitting cavity 166 of chair arm 154 adjacent one side of the fold-down back 150 of the collapsible chair 200. When the locking pin 176 and the push plunger 164 are disposed end-to-end one another within the force-transmission cavity 166 of chair arm 154, the fold-down back 150 is held in the upright position standing vertically above the seat 152. That is to say, the fold-down back 150 cannot be rotated at the pivot posts 86 and 88 of side brackets 66 and 68 from the upright position to the folded position.

Figure 22:
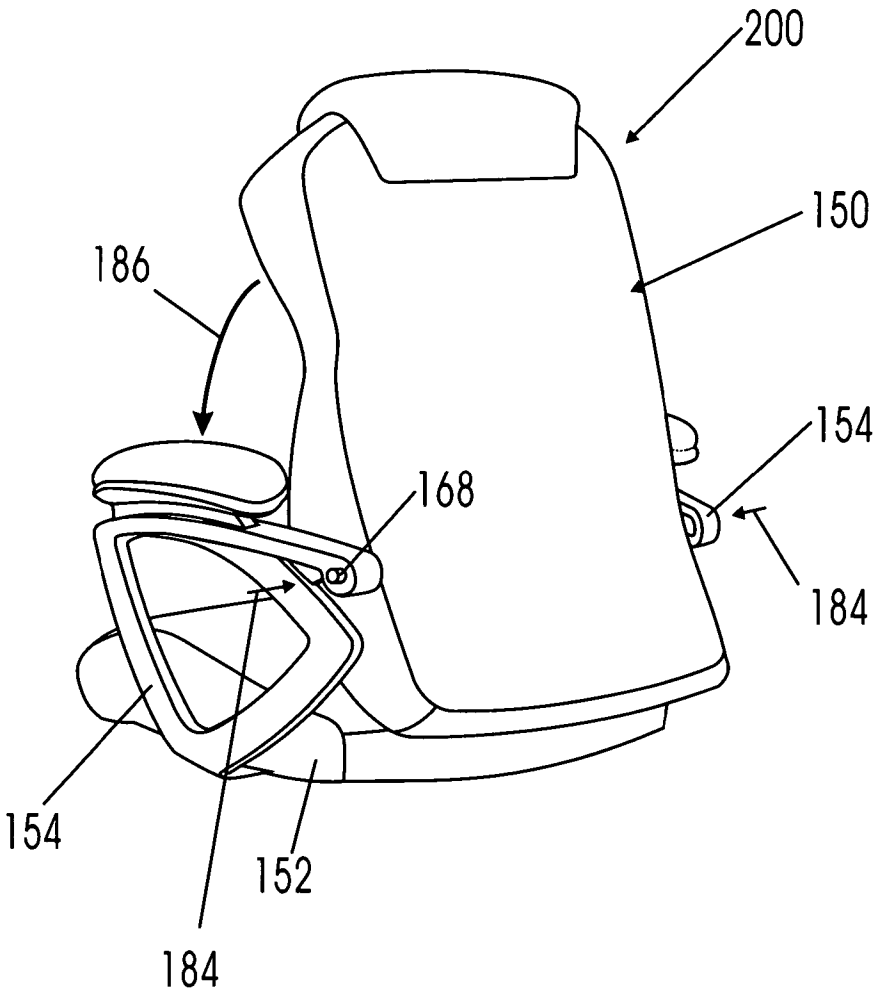
FIG. 22 shows the fold-down back of the collapsible chair of FIG. 17 being rotated from its upright position to its folded position after the push button plungers have been pressed.
Figure 23:
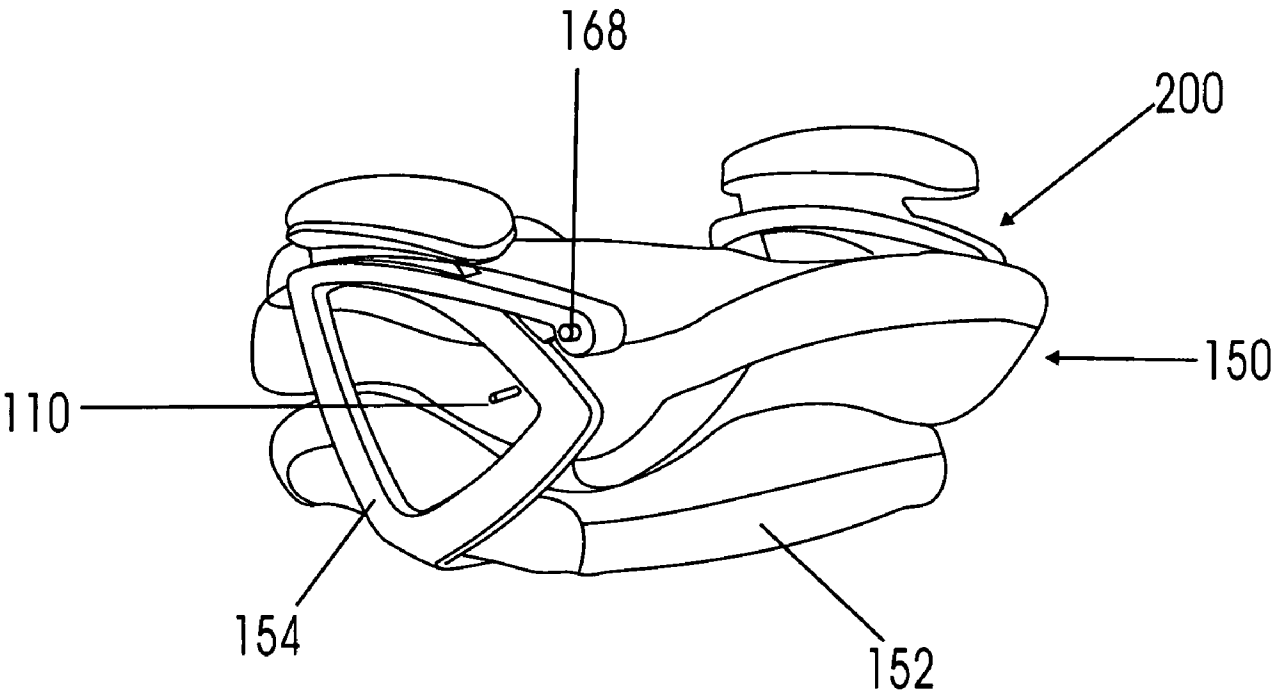
FIG. 23 shows the fold-down back of the collapsible chair after the back is rotated to its folded position lying horizontally over the seat of the chair.

When it is desirable to rotate the fold-down chair back 150 to its folded position of FIG. 23, the user applies an inward pushing force against the push button heads 168 (in the direction of the reference arrows 184 of FIG. 22). The pushing force causes each of the push button plungers 164 (of FIG. 19) to slide inwardly through its push button housing 158 whereby the compression spring 160 will be compressed against the spring stop 162. The pushing forces applied to the push button heads 168 is transmitted to respective ones of the axially-aligned retractable locking pins 176 (of FIG. 21) by plungers 164 at the force-transmission cavity 166 of each chair arm 154. Accordingly, each of the locking pins 176 will be correspondingly pushed inwardly through its locking collar (e.g., 76) so as to be removed from the force-transmission cavity 166 in the chair arm 154. At the same time, the compression spring 182 will be compressed against the stationary locking plug 178 within the locking collar 76.

Once the locking pins 176 have been pushed out of the force-transmission cavities 166 in the chair arms 154, the chair back 150 is free to be rotated at the pivot posts 86 and 88 of the side brackets 66 and 68 (in the direction of the reference arrow 186 of FIG. 22) from its locked upright position of FIG. 18 to its unlocked folded position of FIG. 23 lying over the chair seat 152. The collapsible chair 200 with the fold-down back 150 rotated as shown in FIG. 23 is now in a space-efficient, compact configuration that is ideally suited for either transport or storage.

After the fold-down back 150 has been rotated to its folded position, the pushing force applied to the push button heads 168 is terminated so that each of the compression springs 160 will expand against the spring stop 162 of chair arms 154, and each of the compression springs 182 will expand against the stationary locking plugs 178 of locking collars 74 and 76, whereby to simultaneously drive the formerly-retracted locking pins 176 outwardly from their locking collars 74 and 76 and the inwardly pushed heads 168 of push button plungers 164 outwardly from their push button housings 158. Thus, the locking pins 176 are automatically returned to their original outwardly-extending position shown in FIG. 21 so as to be ready to pop into removable receipt by the force-transmission cavities 166 of chair arms 154 when the chair back 150 is rotated at pivot posts 86 and 88 back to its upright position.

The invention claimed is:

1. A collapsible chair having a seat, a pair of arms, a fold-down back that is rotatable between a locked vertical position standing upwardly from the seat and an unlocked horizontal position lying in generally face-to-face alignment with the seat, and a lock release assembly to control the rotation of said fold-down back, said lock release assembly comprising:

a lock located at said fold-down back and being arranged in removable locking engagement with one of the pair of arms by which to hold the fold-down back in said locked vertical position;

a push button located on said one arm, a manual pushing force applied to said push button causing said push button to move relative to said one arm from a first location to a second location to remove said lock from said removable locking engagement with said one arm, whereby to permit said fold-down back to rotate from its locked vertical position to its unlocked horizontal position, and a locking collar located at one side of the fold-down back of said collapsible chair, said lock being surrounded by and slidable through said locking collar so that said lock is removed from said locking engagement with said one arm when said push button moves from said first location to said second location, said lock including a locking pin projecting outwardly from said locking collar for said removable locking engagement with said one arm.

2. The collapsible chair recited in claim 1, said lock release assembly further comprising a spring located within said locking collar to urge said locking pin to project outwardly from said locking collar and into said removable locking engagement with said one arm, whereby to hold said fold-down back in said locked vertical position.

3. The collapsible chair recited in claim 2, said lock release assembly further comprising a stationary locking plug located within said locking collar, said spring extending between said locking plug and said locking pin.

4. The collapsible chair recited in claim 1, wherein said push button of said lock release assembly includes a push button plunger that is axially-aligned with said locking pin such that said manual pushing force which is applied to said push button to cause said push button to move from said first location to said second location also causes said push button plunger to move towards said locking pin and apply a corresponding pushing force thereto, whereby to remove said locking pin from said removable locking engagement with said one arm.

5. The collapsible chair recited in claim 4, said lock release assembly further comprising a push button housing carried by said one arm and surrounding said push button plunger, and a spring located within said push button housing to urge one end of said push button to project outwardly from said one arm so as to receive said manual pushing force thereagainst.

6. A chair, comprising:

a seat;

a pair of arms lying at opposite sides of the seat;

a fold-down back that is rotatable between a locked vertical position standing upwardly from the seat and an unlocked horizontal position lying in generally face-to-face alignment with the scat; and a lock release assembly to control the rotation of said fold-down back between said locked and unlocked positions, said lock release assembly including a push button located on one arm of said pair of arms and movable relative to said one arm in response to a pushing force being applied to said push button, a locking pin projecting outwardly from said fold-down back to be received in removable locking engagement with said one arm so as to hold said fold-down back in the locked vertical position, and a spring to urge said locking pin to project outwardly from said fold-down back and into said removable locking engagement with said one arm, whereby the pushing force applied to said push button causes said push button to move relative to said one arm for correspondingly causing said locking pin to be removed from its locking engagement with said one arm and said spring to be compressed, whereby to permit said fold-down back to rotate from said locked vertical position to said unlocked horizontal position.

7. The chair recited in claim 6, wherein said locking pin is pushed away from said one arm and inwardly of said fold-down back when said pushing force is applied to said push button to cause said push button to move relative to said one arm and said spring to be compressed so that said fold-down back can be rotated to said unlocked horizontal position, said spring expanding when the pushing force applied to said push button is ended to automatically push said locking pin outwardly from said fold-down back and towards said one arm, whereby said locking pin is returned to its removable locking engagement with said one arm when said fold-down back is rotated back to said locked vertical position.

8. The chair recited in claim 7, wherein said lock release assembly also includes a locking collar carried by said fold-down back, said locking pin being surrounded by and slidable through said locking collar when said locking pin is removed from its locking engagement with said one arm in response to the pushing force applied to said push button and when said locking pin is returned to its removable locking engagement with said one arm when the pushing force applied to said push button is ended.

9. The chair recited in claim 8, wherein the spring of said lock release assembly is located within said locking collar so as to engage said locking pin.

10. The chair recited in claim 9, wherein said lock release assembly also includes a stationary locking plug located within said locking collar, said spring lying between said locking plug and said locking pin.

11. The chair recited in claim 6, wherein said lock release assembly also includes a push button plunger that is axially-aligned with said locking pin such that said pushing force which is applied to said push button to cause said push button to move relative to said one arm also causes said push button plunger to move towards said locking pin and apply a corresponding pushing force thereto, whereby to remove said locking pin from said removable locking engagement with said one arm.

12. The chair recited in claim 11, wherein said lock release assembly also includes a push button housing carried by said one arm to surround said push button plunger, and a biasing spring located within said push button housing to urge said push button to project outwardly from said one arm so as to receive said pushing force.

* * * * *